US007311495B2

(12) United States Patent
Ashley et al.

(10) Patent No.: US 7,311,495 B2
(45) Date of Patent: Dec. 25, 2007

(54) VANE SUPPORT IN A GAS TURBINE ENGINE

(75) Inventors: Duncan E Ashley, Bristol (GB); Peter Allford, Bristol (GB); Martin Lawrence, Bristol (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 11/477,366

(22) Filed: Jun. 30, 2006

(65) Prior Publication Data

US 2007/0104574 A1 May 10, 2007

(30) Foreign Application Priority Data

Jul. 2, 2005 (GB) ..... 0513609.8

(51) Int. Cl.
*F01D 9/00* (2006.01)

(52) U.S. Cl. ..... 415/209.4; 415/210.1

(58) Field of Classification Search ..... 415/191, 415/209.3, 209.4, 210.1, 211.2
See application file for complete search history.

(56) References Cited

U.S. PATENT DOCUMENTS 2,744,680 A * 5/1956 Rainbow et al. ..... 415/209.3
2,957,228 A * 10/1960 Stoddard et al. ..... 29/889.22
4,594,761 A * 6/1986 Murphy et al. ..... 29/889.71
5,074,752 A * 12/1991 Murphy et al. ..... 415/209.4
5,411,370 A 5/1995 Varsik
6,409,472 B1 * 6/2002 McMahon et al. ..... 415/189
6,619,917 B2 * 9/2003 Glover et al. ..... 415/209.3

FOREIGN PATENT DOCUMENTS

GB 1158238 7/1969
GB 2 084 261 A 4/1982
GB 2 115 883 A 9/1983

* cited by examiner

*Primary Examiner*—Ninh H. Nguyen
(74) *Attorney, Agent, or Firm*—Oliff & Berridge PLC

(57) ABSTRACT

A fluid flow machine comprises an array of vanes (2) which are supported at their ends by inner and outer support structures 4, 6. The ends of the vanes are received in slots 8, 10, with resilient material 12 disposed between the vane 2 and the wall of the slot 8, 10. A restraint element 14, 34 is mounted in a recess 26, 28; 48 of the support structure 4, 6 and is engaged by a notch 30, 32 in the vane 2 to restrict axial displacement of the vane 2. Consequently, vibration of the vane in directions perpendicular to the lengthwise direction of the vane are damped by the elastomeric material 12 but bodily axial displacement of the vane 2 is prevented by the restraint elements 14, 34.

9 Claims, 8 Drawing Sheets

VANE SUPPORT IN A GAS TURBINE ENGINE

This invention relates to a fluid flow machine. In particular the invention concerns a flow directing stage in flow series with a fan or compressor or the like. The invention may find use in a lift fan, for example, or in turbomachinary such as a gas turbine engine comprising inner and outer support structures and a vane or series of vanes extending between the support structures.

A gas turbine engine comprises one or more compressor stages and one or more turbine stages. Each compressor and turbine stage comprises rotatable bladed discs and, between the blades of adjacent discs, annular arrays of fixed vanes. The vanes serve to direct the gas (air or combustion gases) from the blades of one disc to those of a succeeding rotary stage so that the gas impinges on the blades of the succeeding rotary stage at an optimum angle. Similar considerations are found in common with a lift fan or the like that is a driven rotary stage used to generate a thrust vector but in which the airflow is not directed into the gas turbine engine.

The stationary vanes are subject to various fluctuating inputs which can cause vibrations to be generated within the vanes. For example, the passage of adjacent moving blades past the vanes creates a fluctuating airflow which can set up such vibrations. This problem is particular acute in relatively large vanes such as those present in the compressor stages of an engine. The vibrations which are generated can cause damage to, and possibly failure of, a vane, with potentially serious consequences as fragments of damaged vanes pass through the engine.

In order to keep the vanes dynamically stable, it is known to mount them resiliently at each end in the inner and outer support structure. An example of such resilient mounting is shown in U.S. Pat. No. 5,411,370 which discloses a gas turbine engine comprising inner and outer support structures and a vane extending between the support structures, at least one end of the vane being resiliently supported in an opening in the respective support structure by a resilient material disposed between the vane and the wall of the opening.

Any vibrations generated within the vane cause elastic deformation of the elastomeric material which serves to damp the vibrations. However, the flexibility of the elastomeric material permits the combination of the vane and the elastomeric material to behave as a spring-mass system in which the vane can oscillate as a rigid body, in the chordwise direction of the vane or axial direction of the engine. All of the resulting deflection is absorbed by the elastomeric material which can thus deteriorate very rapidly unless the operating envelope of the engine is restricted.

According to the present invention, restraint means is positioned on the support structure for engagement by the end of the vane to restrict chordwise displacement of the vane relative to the support structure.

The restraint means thus serves to limit the amplitude of any vibration of the vane as a rigid body in the chordwise direction of the vane. This in turn limits the amount of flexure to which the resilient material is subjected, so prolonging its useful life. In this specification, references to the chordwise direction of the vane mean a direction generally between the leading and trailing edges of the vane. In many cases, this direction will approximate to the axial direction of the engine.

The restraint means may comprise a restraint element accommodated in a recess in the support structure. The recess may be circular to enable the restraint element to be fitted to the support structure at any angle about an axis extending in the lengthwise direction of the vane. This enables a common design of restraint element to be used in vane assemblies in which individual vanes have different stagger angles.

The restraint element may comprise a portion in the form of a bridge which extends across the recess, for example, in a direction transversely of the pressure and suction faces of the vane. The vane may have a notch in its end, extending between the pressure and suction faces, which notch accommodates the bridge so as to locate the vane end with respect to the restraint element in the chordwise direction of the vane.

The restraint element may have a head portion defining a shoulder which locates the restraint element relative to the recess in the lengthwise direction of the vane. The restraint element may have a pair of projections which extend from the head portion on opposite sides of the vane. The bridge may extend between the projections at a position away from the head portion. Alternatively, the head portion may itself constitute the bridge.

The restraint means may be provided at both ends of the vane for restricting any rotational displacement of the vane resultant from restraint at only one end. In such circumstances, where the restraint means comprises a restraint element having a head which defines a shoulder, the shoulders of the restraint elements at opposite ends of the vane may be oriented in the same direction as each other. For example, they may be oriented so as to locate the restraint elements against radially inwards movement relatively to the respective support structure.

For a better understanding of the present invention and to show more clearly how it may be carried into effect, reference will now be made, by way of example, to the accompanying drawings, in which.

Figure 1:
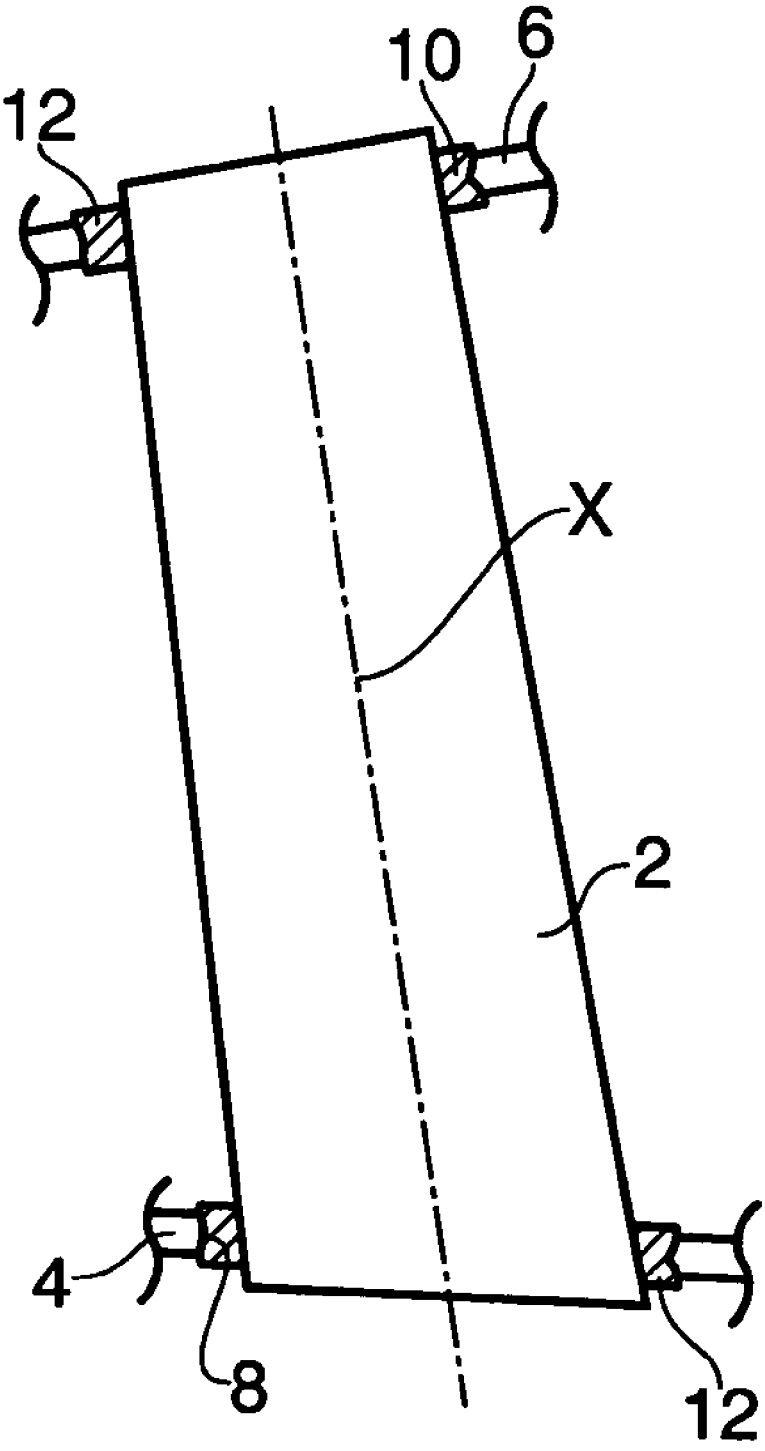
FIG. 1 is a sectional view of a stator vane mounted in support structures in accordance with the prior art.
Figure 2:
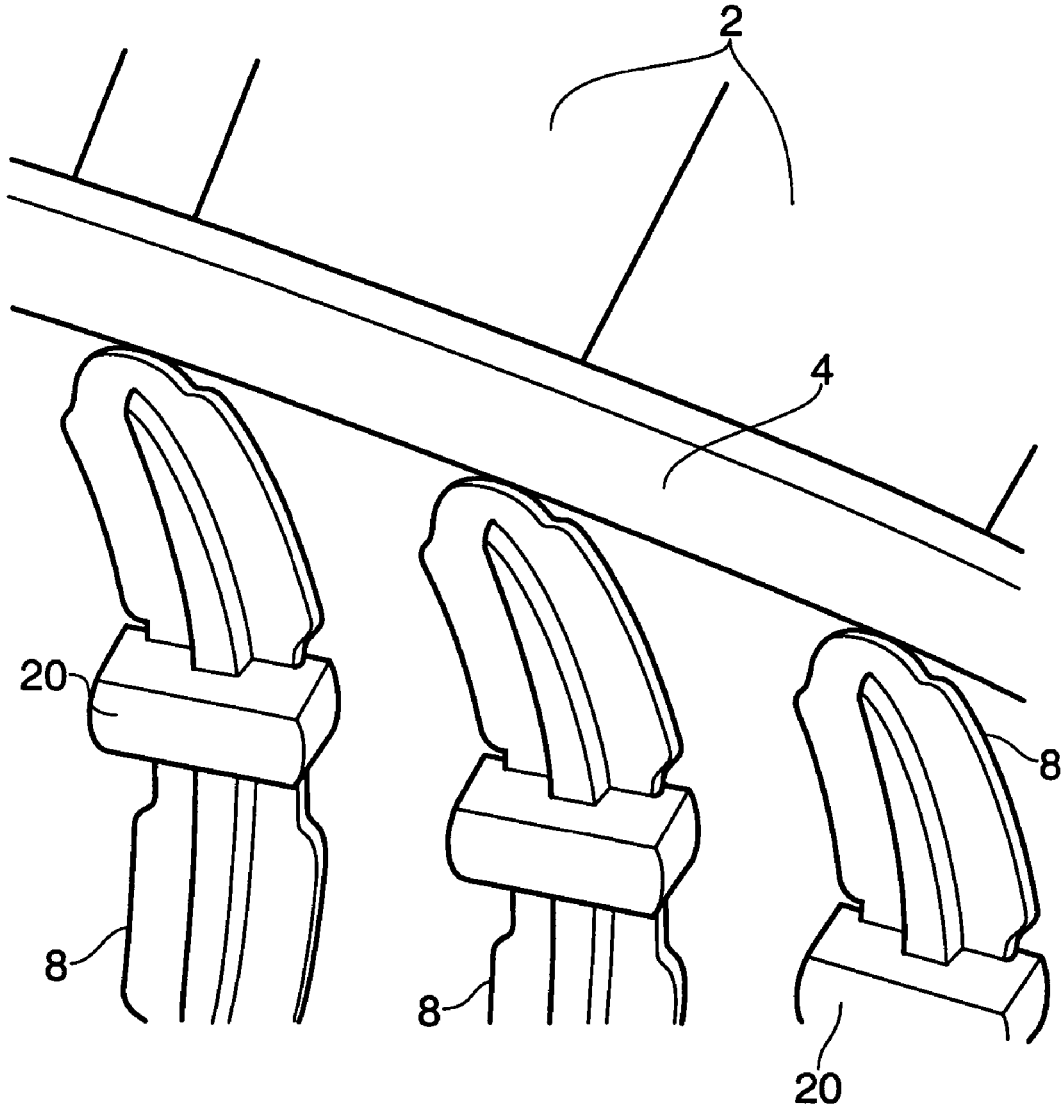
FIG. 2 is a view in a generally radially outwards direction of an inner support structure in accordance with the present invention.
Figure 3:
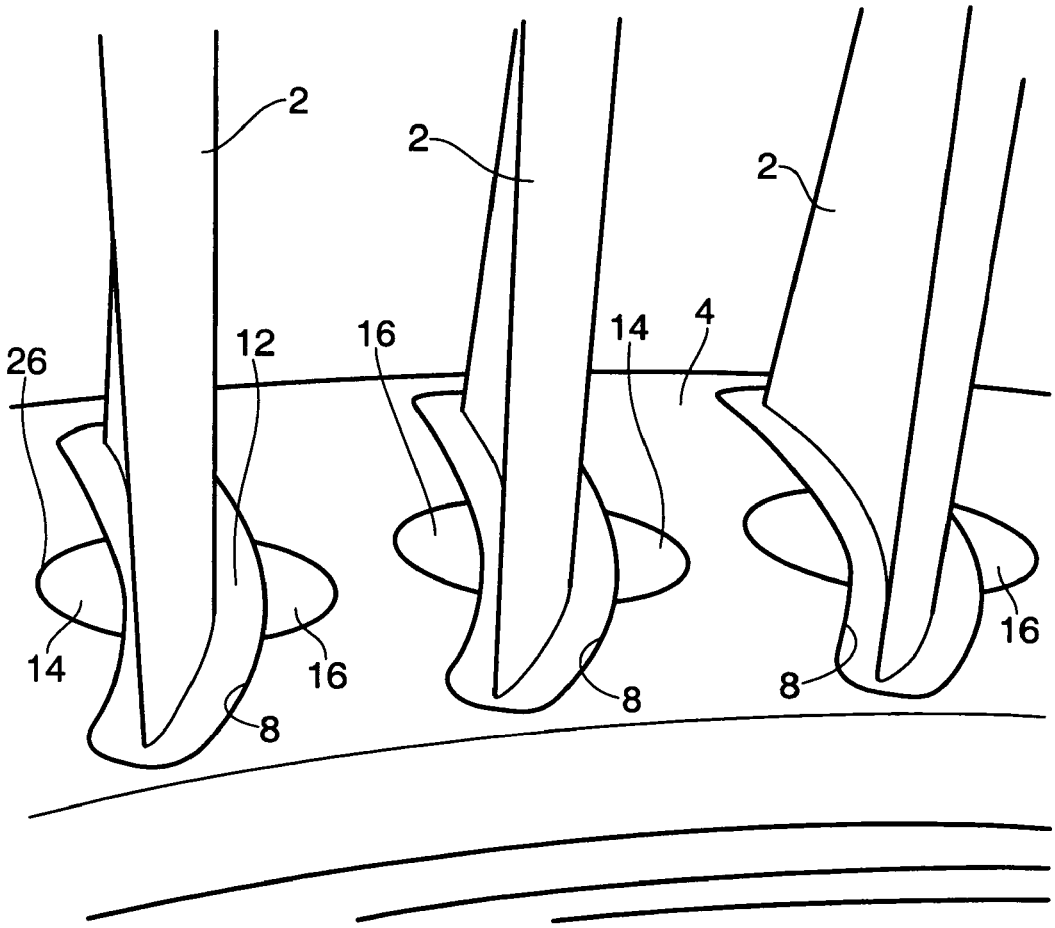
FIG. 3 is a view in a generally radially inwards direction of the support structure of FIG. 2.

In the known assembly shown in FIG. 1, a vane 2 is supported in inner and outer support structures 4, 6 of a lift fan or gas turbine engine. In the context of the present invention, references to "inner" and "outer" refer to the axis of the rotary stage of which the vane 2 is part.

The inner and outer support structures 4, 6 are each provided with an opening or slot 8, 10 which has generally the shape of the end of the vane 2 received within the slot 8, 10. The vane 2 has the shape of an airfoil, although the cross-section of the vane 2 varies along its length. As can be seen from FIG. 1, the openings 8, 10 are somewhat larger than the ends of the vane which are accommodated in them, and the resulting gap is filled with a resilient material 12 such as an elastomer, which supports the vane 2 in the support structures 4 and 6. The elastomer 12 may be a separately formed component which is assembled with the vane 2 and the support structures 4 and 6, or it may be formed and cured in situ with the vane 2 supported in position within the slots 8, 10.

It will be appreciated that displacement of the ends of the vane 2 in a direction transverse to the length of the blade (indicated generally by the line X), ie in the circumferential or axial direction of the rotary stage or engine, will be absorbed by compression and extension of the material 12, the displacement being limited by closure of the gap between the vane 2 and the support structure 4 or 6.

Circumferential displacements transversely to the lengthwise direction X, commonly arise as a result of vibrations generated in the vane 2 as a result of fluctuating forces imposed upon it during operation. The elastomeric material 12 serves to damp these vibrations. However, a self-excited vibration mode can also occur, in which the vane 2 moves in its chordwise direction as a rigid body. These movements result in flexure of the elastomeric material 12, and this can cause the elastomeric material 12 to deteriorate.

FIGS. 2 to 8 show an embodiment in accordance with the present invention. In this embodiment, the inner and outer support structures 4, 6 are again provided with openings or slots 8, 10 which receive the ends of the vanes 2. Elastomeric material in the form of boots 12 fills the gap between the vanes 2 and the slots 8, 10.

At the radially inner end of each vane 2, an inner restraint element 14 is provided. The restraint element 14 is preferably made from a material, such as an alloy, which is significantly harder than the vane material to prevent wear of the restraint element. The restraint element 14 comprises a divided head portion 16, from which extend a pair of projections 18. A bridge 20 extends between the projections 18. A slot 22 is defined by the head portion 16, the projections 18 and the bridge 20.

The outer peripheries of the two parts of the head portion 16 are in the form of arcs which lie on a common circle. Similarly, the two projections 18 have arcuate outer surfaces, with the arcs again lying on a common circle which is concentric with, but smaller than, the circle of the outer peripheries of the head portion 16. Consequently, there is a shoulder 24 at the transition between the head portion 16 and the projections 18.

The inner support structure 4 is provided with recesses which overlap the respective slots 8. Each of these recesses comprises an upper portion 26 which opens at the surface of the inner support structure 4 from which the vane 2 projects, and which has a diameter corresponding to that of the head portion 16. Beneath the upper portion 26, the recess has a lower portion 28 which is also circular but has a diameter corresponding to that of the projection 18. Thus, the recess has a shoulder (not shown) between the upper and lower portions 26, 28. When the inner restraint element 14 is fitted into the recess, the head portion 16 and the projections 18 fit respectively within the upper and lower portions 26, 28 of the recess, and the shoulder 24 abuts the shoulder within the recess. The restraint element may be secured in the recess by a suitable sealant.

Figure 8:
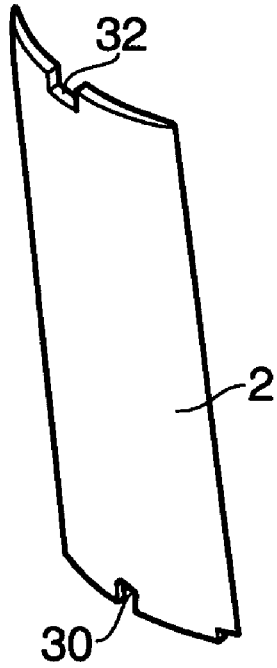
FIG. 8 shows a vane of the support structures shown in FIGS. 2 to 5.

The vane 2 as shown in FIG. 8 has notches 30 and 32 provided at its radially inner and outer ends respectively. The inner end of the vane 2 fits within the slot 22, and the bridge 20 fits within the notch 30.

Consequently, in the assembled structure, the inner end of the vane 2 can move in circumferential direction transversely of the lengthwise direction of the vane 2, this movement being damped by the elastomeric material 12 which, as before, can either be formed in situ or made as a separate component to be fitted during an assembly of the structure. However, movement in the chordwise direction of the vane is limited by the cooperation between the notch 30 at the inner end of the vane 2 and the bridge 20.

Figure 4:
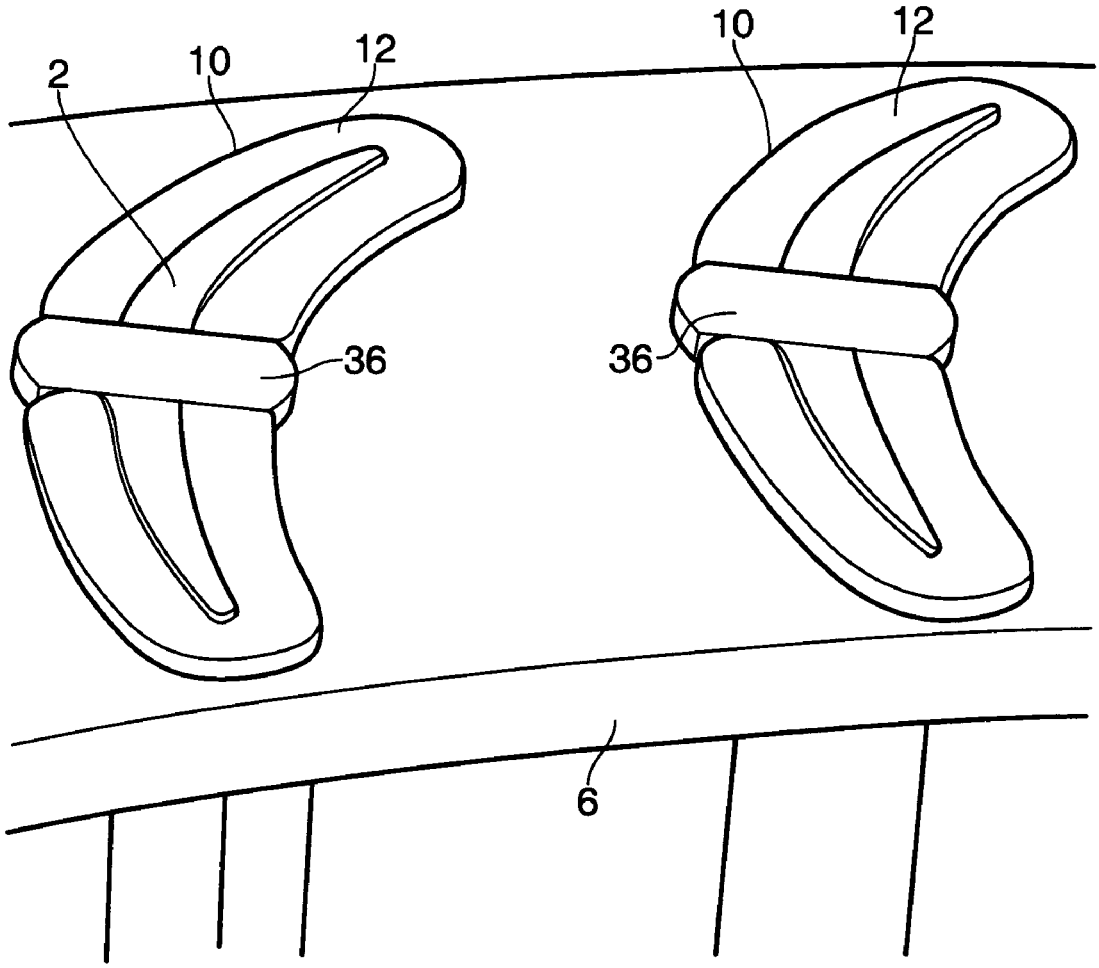
FIG. 4 is a view in a generally radially inwards direction of an outer support structure in accordance with the present invention.
Figure 5:
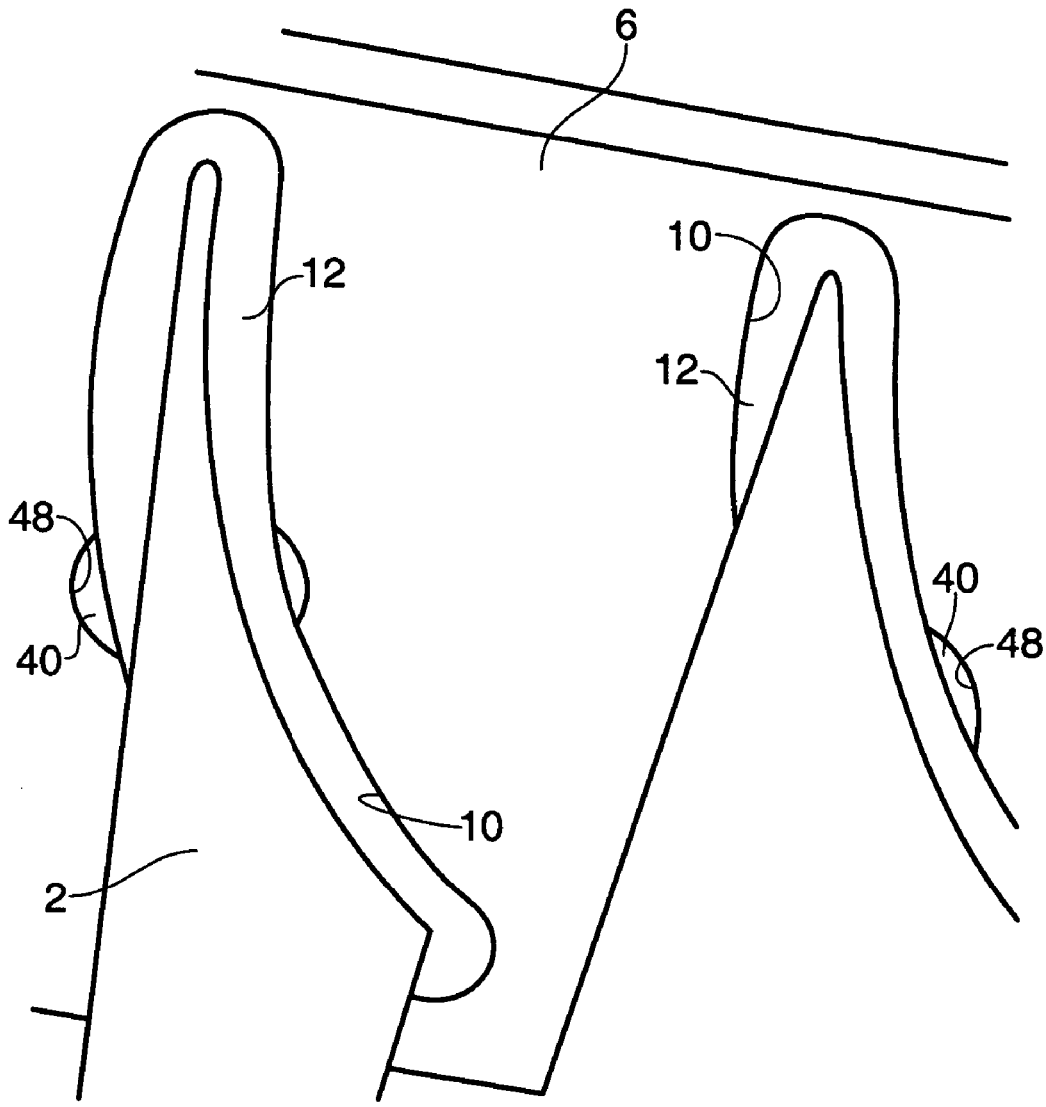
FIG. 5 is a view in a generally radially outwards direction of the support structure of FIG. 4.
Figure 6:
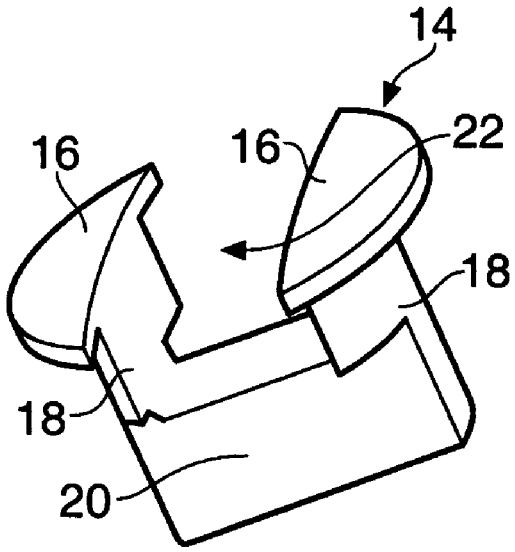
FIG. 6 shows an inner restraint element of the support structure of FIGS. 2 and 3.
Figure 7:
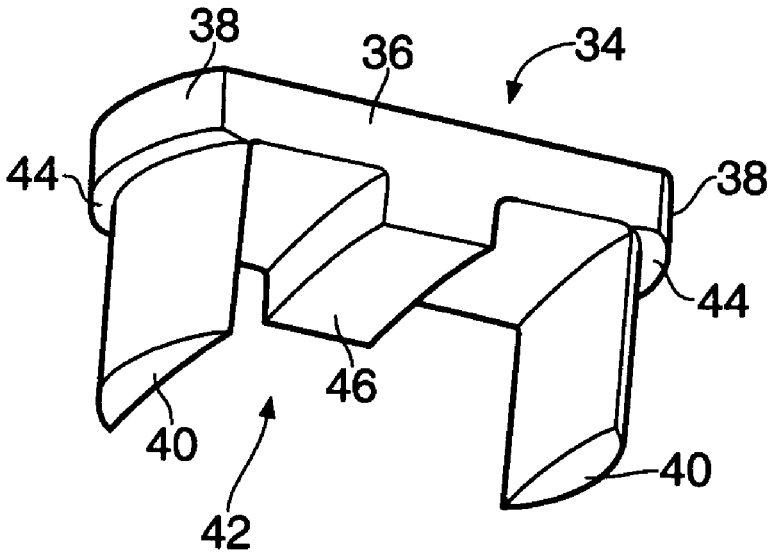
FIG. 7 shows an outer restraint element for use in the support structure shown in FIGS. 4 and 5.

A similar structure is provided at the radially outer end of each vane 2, as shown in FIGS. 4, 5 and 7. At the radially outer end of each vane, an outer restraint element 34, which may be made from the same material as that of the inner restraint element 14, is provided as shown in FIG. 7. The outer restraint element 34 comprises a head portion 36 having arcuate ends 38 which lie on a common circle. Projections 40 extend from the head portion 36 and, as with the projections 18 of the inner restraint element 14, these have an arcuate outer periphery lying on a common circle having a diameter smaller than that of the arcuate ends 38 of the head portion 36. The head portion 36 and the projections 40 define a slot 42. The transition between the head portion 36 and the projections 40 define shoulders 44. The face of the head portion 36 directed towards the projections 40 is provided with a central rib 46. As shown in FIGS. 4 and 5, the outer structure 6 has a recess 48 which receives the projections 40 of the outer restraint element 34, where they are secured by a sealant. The head portion 36 abuts the outer surface of the outer support structure 6 to locate the restraint element 34 axially with respect to the outer support structure 6. The outer support structure 6 is situated within a further component (not shown) which has a bore diameter slightly larger than that of the outer tips of the vanes 2. Consequently, the outer restraint elements 34 are retained within the recesses 48 should the sealant degrade.

The outer end of the vane 2 extends into the slot 42, and the notch 32 receives the rib 46. The rib 46 serves to increase the bearing area between the vane 2 and the restraint element 34. Thus, as with the structure at the inner end of the vane 2, the elastomeric material 12 serves to damp oscillations of the vane 2 in directions perpendicular to the lengthwise direction of the vane 2, while the outer restraint element 34 restricts bodily chordwise displacement of the vane 2.

In some circumstances, it is necessary for the vanes 2 in an annular stator array to have different stagger angles from each other. That is to say, the angular position about the lengthwise direction of the vane 2 differs from blade to blade. This is necessary, for example, for the vanes to function properly in directing gas flow through the engine should the gas flow path for one or more of the vanes be disrupted by, for example, stationary support structure of the engine. The stagger angle of each vane 2 is determined by the position of its slot 8, 10, and the inner and outer restraint elements 14, 34 can adapt to the stagger angle by rotating in their recesses 26, 28; 48 owing to the circular profile of the restraint elements.

Figure 9:
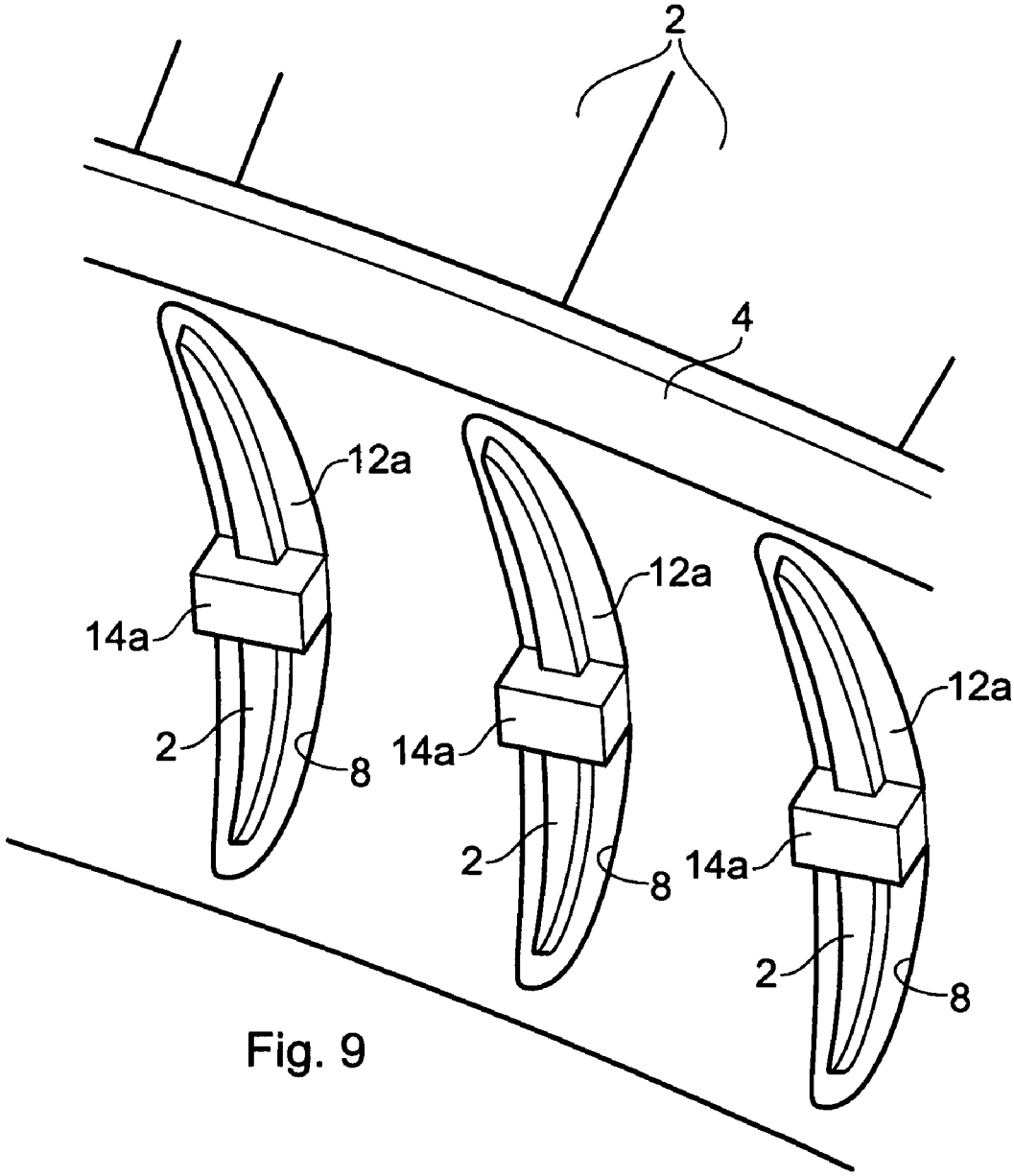
FIGS. 9, 10 and 11 relate to a modified arrangement and correspond to the views of FIGS. 2, 3 and 6 of the first arrangement.
Figure 11:
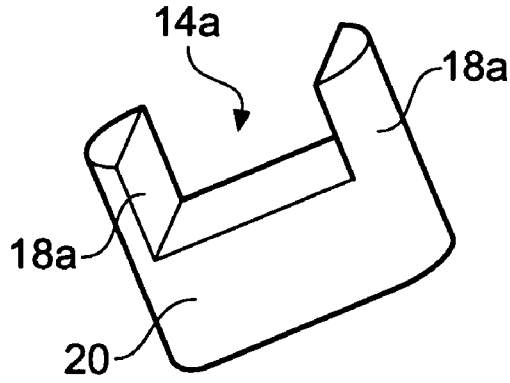
Figure 10:
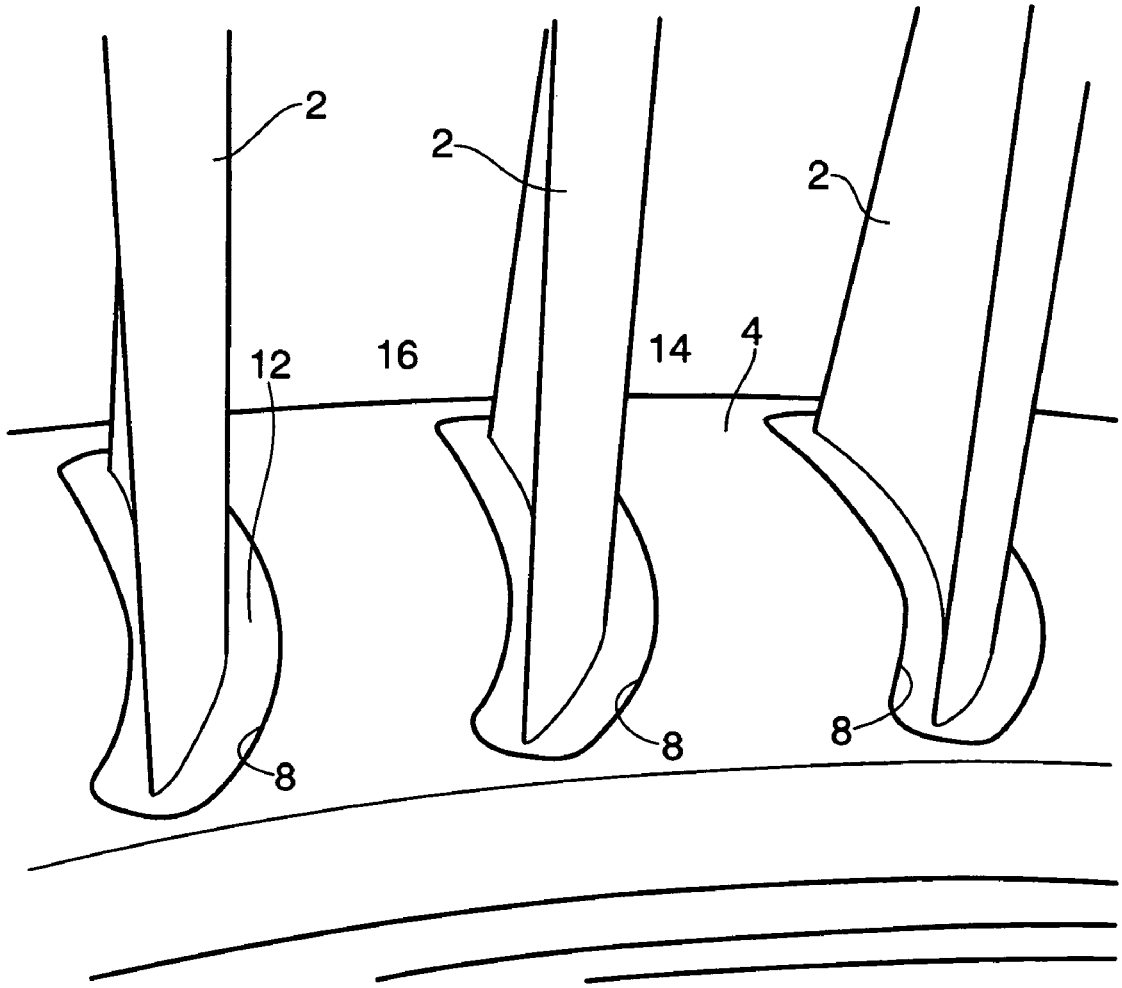

FIGS. 9, 10 and 11 illustrate a modified arrangement for restraining the radially inner end of the vanes 2. As previously described the radially inner end of each vane 2 is received into an opening or slot 8, formed in the inner support structure 4, and is positively located using a modified restraint element **14*a* and a boot 12*a* of elastomeric material to fill a gap between the surface of the vane 2 and the periphery of the slot 8**.

The modified restraint element **14*a* has a simplified design. In comparison with the design of the element 14 described above, and illustrated in FIG. 6, the wider head portion 16 of element 14 is omitted from the element 14*a*. Instead it comprises only the bridge 20 flanked at either side by plain, upstanding projections 18***a*. The profile of slot 8 in the inner support structure 4 is correspondingly simplified in that there is no longer a need for the part-circular circular recesses 26 in the sides of the vane slot 8 to receive the part-circular portions of the head portion 16. Instead opposite sides of the slot 8 have notches to receive the projections 18*a*. The lengths of the projections 18*a* and of the receiving slots are also reduced so that the distal ends of projections do not extend to the gas washed surface of the inner support 4. The outer edge surfaces, that is the outer sides of the projecting arms 18*a* and bridge piece 20 that engage the sides of the vane slot 8 correspond in profile to the sides of slot 8. The engaging surfaces are curved although not necessarily in conformance with circular or cylindrical surfaces.

In assembled condition the restraint element 14*a* is glued into position, using an appropriate adhesive material, and the volume between the surface of vane 2 and the side surfaces of the slot 8 are filled with elastomeric material, resiliently mounting the vane in position. The surface of this elastomeric in-fill material is preferably finished flush with surfaces of the support structure 4. In particular, on the gas path side of the structure 4 as shown in FIG. 10, the surface of the elastomeric material does not protrude into the gas path. This arrangement has reduced perimeter length and is easier to produce with a smooth, flush surface. On the under side of the structure 4, see FIG. 9, it is also finished flush with the surface of the structure, that is without an overlapping lip shown above in the first arrangement.

The invention claimed is:

1. A fluid flow machine comprising inner and outer support structures and a vane extending between the support structures, at least one end of an airfoil section of vane being inserted through an airfoil-shaped opening formed in the respective support structure and resiliently supported therein by elastomeric material disposed between the vane and an edge of an opening in the support structure, characterised in that the airfoil-shaped opening is further adapted with a circular recess to receive restraint means in the form of a restraint element having a circular outer profile to engage the circular recess and a portion adapted to engage an end of the vane whereby to restrict chordwise displacement of the vane relative to the support structures.

2. A fluid flow machine as claimed in claim 1, characterised in that the restraint element has a shoulder portion to engage the circular recess in the support structure.

3. A fluid flow machine as claimed in claim 2, in which the restraint element comprises a portion which extends across the opening.

4. A fluid flow machine as claimed in claim 1, in which the restraint element comprises a portion which extends across the opening.

5. A fluid flow machine as claimed in claim 4, characterised in that the vane has a notch which receives the portion of the restraint element extending across the opening.

6. A fluid flow machine as claimed in claim 1 characterised in that the restraint element comprises a head portion having a shoulder which locates the restraint element relative to the recess in a direction extending lengthwise of the vane.

7. A fluid flow machine as claimed in claim 6, characterised in that the restraint element comprises projections which extend from the head portion on opposite sides of the vane.

8. A fluid flow machine comprising inner and outer support structures and a vane extending between the support structures, the vane having at least one end resiliently supported in an opening formed in the respective support structure and retained therein by resilient material disposed between the vane and the wall of the opening, wherein the end of the vane is engaged by restraint means comprising a restraint element accommodated in a recess formed in the support structure to restrict chordwise displacement of the vane relative to the support structures, and wherein a said restraint means is provided at each end of the vane.

9. A fluid flow machine comprising inner and outer support structures and a vane extending between the support structures, the vane having at least one end resiliently supported in an opening formed in the respective support structure and retained therein by resilient material disposed between the vane and the wall of the opening, wherein the end of the vane is engaged by restraint means comprising a restraint element accommodated in a recess formed in the support structure to restrict chordwise displacement of the vane relative to the support structures, and wherein the vane is one of a plurality of vanes in a circumferential array, at least two of the vanes having stagger angles which are different from each other.

* * * * *